US008464409B2

(12) United States Patent
Nauche

(10) Patent No.: US 8,464,409 B2
(45) Date of Patent: Jun. 18, 2013

(54) MACHINE FOR SHAPING AN EYEGLASS LENS, THE MACHINE BEING PROVIDED WITH A TURNABLE TOOL-CARRIER HAVING A PLURALITY OF WORKING TOOLS MOUNTED THEREON

(75) Inventor: Michel Nauche, Charenton (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 946 days.

(21) Appl. No.: 12/525,916

(22) PCT Filed: Jan. 14, 2008

(86) PCT No.: PCT/FR2008/000039

§ 371 (c)(1),
(2), (4) Date: Aug. 5, 2009

(87) PCT Pub. No.: WO2008/107532

PCT Pub. Date: Sep. 12, 2008

(65) Prior Publication Data

US 2010/0009603 A1 Jan. 14, 2010

(30) Foreign Application Priority Data

Feb. 13, 2007 (FR) ..... 07 01037

(51) Int. Cl.

| | |
|---|---|
| ***B23P 23/00*** | (2006.01) |
| ***B24B 9/14*** | (2006.01) |
| ***B23B 41/00*** | (2006.01) |
| ***B23B 29/32*** | (2006.01) |

(52) U.S. Cl.
USPC ..... 29/26 A; 29/28; 29/40; 451/43; 451/71; 451/256; 82/121

(58) Field of Classification Search
USPC ..... 29/28, 27 R, 27 C, 26 R, 26 A, 36, 29/40; 451/255–256, 42–43, 71, 65; 82/121
See application file for complete search history.

(56) References Cited

U.S. PATENT DOCUMENTS 5,490,307 A * 2/1996 Link ..... 29/27 C
5,993,295 A 11/1999 Raffaelli (Continued)

FOREIGN PATENT DOCUMENTS

FR 2614227 10/1988
FR 2887168 12/2006

(Continued)

OTHER PUBLICATIONS

International search report dated Nov. 17, 2008 in corresponding PCT/FR2008/000039.

*Primary Examiner* — Erica E Cadugan
(74) *Attorney, Agent, or Firm* — Young & Thompson

(57) ABSTRACT

The machine includes: elements for supporting the lens and for driving it in rotation about a first axis of rotation, the rotation of the lens being driven by first driver element, a tool-carrier mounted to turn about a second axis of rotation, turning of the tool-carrier being driven by second driver element, a plurality of working tools mounted on the tool-carrier to rotate about tool axes, with at least two of the tools including tools for shaping the periphery of the lens for shaping having distinct tool axes, third driver element for driving relative spacing movements between the first axis of rotation and the second axis of rotation, swivel elements for enabling the tool-carrier to be pivoted relative to the first axis of rotation about a third axis of rotation that extends substantially transversely to the first axis of rotation.

16 Claims, 3 Drawing Sheets

U.S. PATENT DOCUMENTS

| | | | | |
|---|---|---|---|---|
| 6,128,812 | A * | 10/2000 | Link et al. | 29/40 |
| 6,311,591 | B1 * | 11/2001 | Grossmann | 82/121 |
| 6,383,061 | B1 * | 5/2002 | Mandler | 451/43 |
| 6,790,124 | B2 | 9/2004 | Shibata | |
| 6,865,789 | B2 * | 3/2005 | Katoh et al. | 29/40 |
| 7,455,569 | B2 * | 11/2008 | Schafer et al. | 451/11 |
| 7,975,355 | B2 * | 7/2011 | Nauche et al. | 29/26 A |
| 2003/0013392 | A1 * | 1/2003 | Guillermin | 451/384 |
| 2010/0093265 | A1 * | 4/2010 | Lemaire et al. | 451/294 |

FOREIGN PATENT DOCUMENTS

| | | | |
|---|---|---|---|
| JP | 1058209 | A | 3/1989 |
| JP | 11216651 | A | 8/1999 |
| JP | 2001219349 | A | 8/2001 |
| JP | 2003145328 | A | 5/2003 |

* cited by examiner

Fig.5

Other finisher tools such as a chamfering disk, a grooving tool, or a polishing tool can be used.

MACHINE FOR SHAPING AN EYEGLASS LENS, THE MACHINE BEING PROVIDED WITH A TURNABLE TOOL-CARRIER HAVING A PLURALITY OF WORKING TOOLS MOUNTED THEREON

TECHNICAL FIELD TO WHICH THE INVENTION RELATES

The present invention relates in general to mounting ophthalmic lenses of a pair of correcting eyeglasses on a frame, and it relates more particularly to a machine and a method for shaping a lens.

TECHNOLOGICAL BACKGROUND

The technical portion of the work of an optician consists in mounting a pair of ophthalmic lenses on the frame selected by the future wearer. To do this, the optician needs to shape each lens, which operation consists in modifying the outline of the lens to adapt the lens to the frame and/or to the desired lens shape.

Conventionally, shaping comprises two main operations comprising an edging operation (often referred to as "roughing") and a finishing operation that depends on the type of frame.

Edging consists in eliminating the unwanted peripheral portion of the ophthalmic lens in question, so as to bring its outline, which is generally initially circular, down to the arbitrary outline of the rim or the surround of the frame, or merely to the desired esthetic shape when the frame is of the rimless type. This edging operation is usually followed by a chamfering operation which consists in rounding or chamfering the two sharp edges surrounding the edged lens.

The finishing operation depends on the type of frame. With a rimmed frame, a beveling operation is performed that consists in shaping a ridge that is usually referred to as a bevel. The bevel is designed to be engaged in a corresponding groove, commonly known as a bezel, that is formed in the rim or surround of the eyeglass frame in which the lens is to be mounted. When the frame is of the rimless type, the shaping of the lens and optionally the rounding of its sharp edges (chamfering) are followed by appropriate drilling of the lenses so as to enable the temples and the nose bridge of the rimless frame to be fastened thereto. Finally, when the frame is of the half-rimmed type with nylon string, the chamfering is accompanied by a grooving operation that consists in forming a groove in the edge face of the lens, the groove serving to receive the nylon string of the frame that serves to press the lens against the rigid portion thereof.

Usually, the lens is shaped on a numerically controlled grinder that possesses means for holding the lens and for driving it in rotation, together with a plurality of working tools suitable for the various operations that are to be performed.

Usually the working tools comprise in particular a roughing grindwheel and a beveling grindwheel that are mounted on a common rotary drive shaft that constitutes the main working module. The drilling, grooving, and chamfering tools, and also special tools for machining certain types of lens, such as strongly curved lenses, are disposed on other distinct working modules.

Such a machine occupies a large amount of space and is expensive because it requires at least one motor to be provided per working module.

In a particular embodiment shown in its FIG. 2, document FR 2 614 227 proposes combining some of the above-mentioned working tools on a common rotary tool-carrier that is mounted to turn about an axis of rotation. The working tools are also mounted to rotate about distinct tool axes that are substantially parallel to the axis of rotation of the tool-carrier. According to the teaching of that document, the working tools mounted on the tool-carrier are solely the tools for shaping the periphery of the lens and the freedoms of movement of those working tools to move relative to the lens for machining are few.

The variety of lens-processing operations that can be performed with that tool-carrier is therefore limited.

OBJECT OF THE INVENTION

An object of the present invention is to increase the variety of lens-processing operations made available by a shaper machine that includes a rotary tool-carrier, while continuing to have a machine that is compact.

To this end, the invention provides a shaper machine for shaping an ophthalmic lens for eyeglasses, the machine comprising:

- means for supporting the lens and for driving it in rotation about a first axis of rotation, the rotation of the lens being driven by first drive means;
- a tool-carrier mounted to turn about a second axis of rotation, the rotation of the tool-carrier being driven by second drive means;
- a plurality of working tools mounted on the tool-carrier to rotate about respective tool axes, at least two of the tools comprising tools for shaping the periphery of the lens for shaping and having distinct tool axes;
- third drive means for driving relative spacing movements between the first axis of rotation and the second axis of rotation; and
- swivel means enabling the tool-carrier to pivot relative to the first axis of rotation about a third axis of rotation that extends substantially transversely relative to the first axis of rotation.

The freedom to move the axis of the tool-carrier in swiveling relative to the axis of rotation of the lens enables the angle of inclination of the axis of the drill tool to be controlled, and thus enable holes to be drilled with the desired orientation and shape. The fact that the freedom to move in swiveling applies to the entire tool-carrier also makes it possible to control the angle of inclination of the axes of the other tools for shaping the periphery, thereby enabling the shape desired for the periphery of the lens to be reproduced accurately.

In particular, it is thus possible to adjust the angle of inclination of the axis of the finisher tool for shaping the periphery of the lens to be shaped (typically a beveling grindwheel or a grooving grindwheel). It is also possible to make use of the same freedom of the tool-carrier to move in swiveling to adjust the angle of inclination of the roughing tool for shaping the periphery of the lens to be shaped (typically an edging roughing grindwheel), thereby making it possible to obtain an edge face for the roughed-out lens that is at an angle of inclination that corresponds to the angle desired for finishing purposes. The finishing operation is thus made easier (since it requires less matter to be removed and matter to be removed in a more uniform manner), thereby enabling finishing to be performed more quickly and with better accuracy, while wear of the finishing tool is reduced and made more uniform.

Furthermore, the freedom of the tool-carrier axis to move in swiveling can be combined with another degree of freedom, prior to machining and/or dynamically during machining of the lens, to obtain an ideal three-dimensional position for the tool relative to the lens.

For lenses that are strongly cambered and on which it is desired to form a peripheral bevel or groove, the angle of inclination of the axis of a working tool, such as a beveling tool or a grooving tool, enables the shape and the orientation of each section of the beveled or grooved periphery of the lens to be well adapted in three dimensions and limits the phenomenon whereby the bevel or the groove becomes pared away while it is being formed.

Such a tool-carrier also enables a wide variety of treatment operations to be performed on lenses while using a small number of parts and freedoms of movement.

Since each working tool is mounted alone on its own axis of rotation, there is no longer any need, when the tool is to be replaced, to remove other working tools (as happens in the state of the art when a plurality of tools are mounted on a common axis). Only the working tool that has been replaced needs to be recalibrated, there is no need to recalibrate any other working tools since they remain unaffected by the replacement.

In addition, because of the freedom of the tool-carrier to turn about the axis of rotation and because of the way the tools are distributed about said axis of rotation, a single motor suffices to bring the selected working tool into register with the lens. The overall size and cost of the machine are thereby reduced.

According to a first advantageous characteristic of the invention, the working tools include a drill tool. Because of the presence of the drill tool on the tool-carrier of the invention, it is possible using a single tool-carrier and the freedoms of movement that it possesses, not only to shape the periphery of lenses by means of the corresponding working tools, but also to drill lenses that are to be mounted in drilled type frames. There is no need to provide an additional separate drill module.

According to another advantageous characteristic of the invention, the axis of at least one of the working tools and the second axis of rotation of the tool-carrier are arranged in such a manner that when said working tool has been selected and the tool-carrier has been turned into a working position for said working tool, the axis of said working tool is inclined relative of the first axis of rotation, typically by an angle that is greater than or equal to 5 degrees. This angle of inclination may be fixed, or advantageously it may depend on the general curvature of the lens and the general shape of the final outline desired for the lens after shaping.

According to another advantageous characteristic of the invention, there are provided means for selecting one of the working tools to proceed with a step of working the lens, and control means for controlling the second driver means designed to cause the tool-carrier to turn about the second axis of rotation in such a manner as to bring the selected working tool into register with the lens.

Under such circumstances, and advantageously:

- the means for swiveling the tool-carrier about the third axis of rotation are driven by fourth driver means before and/or during machining of the lens and under the control of the control means;
- the control means are designed to control the fourth driver means for driving the means for swiveling the tool-carrier about the third axis of rotation in coordination with the first driver means for rotating the lens; and
- the control means are designed to control the second driver means for turning the tool-carrier about the second axis of rotation in coordination with the first driver means for rotating the lens.

This control is advantageously performed as a function of the local or overall curvature of the front, rear, or mean surface of the shaped lens at the current machining points and as a function of the radius of the shaped outline desired at this point.

According to another advantageous characteristic of the invention, the shaper tools include at least one edger tool for shaping the lens to have a flat edge face, and at least one finisher tool constituted by at least one of the following tools: a beveling grindwheel, a chamfering disk, a grooving tool, and a polishing tool.

According to another advantageous characteristic of the invention, the shaper tools are of different diameters from one another and the axes of rotation of the shaper tools are situated at different distances from the second axis of rotation. In particular, provision can be made for the tool-carrier to include a roughing grindwheel and a finisher grindwheel for shaping the periphery of the lens for shaping, with the diameter of the roughing grindwheel being significantly greater than that of the finisher grindwheel, the difference in diameters typically being greater than 10 millimeters.

According to another advantageous characteristic of the invention, each working tool comprises an active portion that defines a working envelope during rotation of the working tool about its axis, the useful portion of said working envelope being situated at a maximum distance from the second axis of rotation that is the same for at least two of the shaper tools.

The tilting stroke for bringing the lens into contact with the working tool is thus made small. This also enables the machine to be made more compact.

According to another advantageous characteristic of the invention, the machine includes coupler means for coupling the working tools with a common motor that drives them in rotation, the coupler means being designed to enable the coupling of at least one of the working tools to be declutched when said tool is inactive and to clutch the coupling between said tool and the common motor when the tool-carrier is in the working position of said tool. The couplings of tools that are not active are thus declutched so as to reduce the wear of their drive gearing and of the tool bearings, and also reduce the nuisance of the noise generated by the machining operation, thereby enhancing the lifetime and the accuracy of the machining.

According to another advantageous characteristic of the invention, the lens support comprises two shafts, both arranged on the first axis of rotation, for clamping the lens between their facing free ends, each shaft having a terminal portion of reduced diameter at its free end. It is thus possible to work the peripheries of lenses that are of small diameter.

The invention also provides a method of shaping a lens by means of a shaper machine as defined above, the method comprising the following steps:

- turning the tool-carrier about the second axis of rotation so as to position the edger tool in register with the lens;
- roughing out edging of the lens by means of the edger tool;
- turning the tool-carrier about the second axis of rotation to position the finisher tool in register with the lens; and
- finishing the beveling or the grooving of the lens by means of the finisher tool with the tool-carrier being at a non-zero angle of inclination about the third axis of rotation.

This method is advantageously applied systematically to shaping all lenses independently of their camber, and in particular it is even applied to shaping lenses having a front face that is inscribed in a sphere of radius greater than 12 centimeters.

The invention also provides a method of shaping a lens by means of a shaper machine as defined above, the method comprising the following steps:

turning the tool-carrier about the second axis of rotation so as to position the edger tool in register with the lens;

roughing out edging of the lens by means of the edger tool with the tool-carrier at a non-zero angle of inclination about the third axis of rotation;

turning the tool-carrier about the second axis of rotation to position the finisher tool in register with the lens; and finishing the beveling or the grooving of the lens by means of the finisher tool at the same angle of inclination of the tool-carrier.

This produces a beveled edge that is accurate and suitably oriented, thereby improving the appearance and the accuracy of mounting in a frame. This also avoids any risk of it being necessary to rework the shaping, thus representing an appreciable saving of time for the optician.

DETAILED DESCRIPTION OF AN EMBODIMENT

The following description with reference to the accompanying drawings given by way of non-limiting example makes it well understood what the invention consists in and how it can be reduced to practice.

Figure 3:
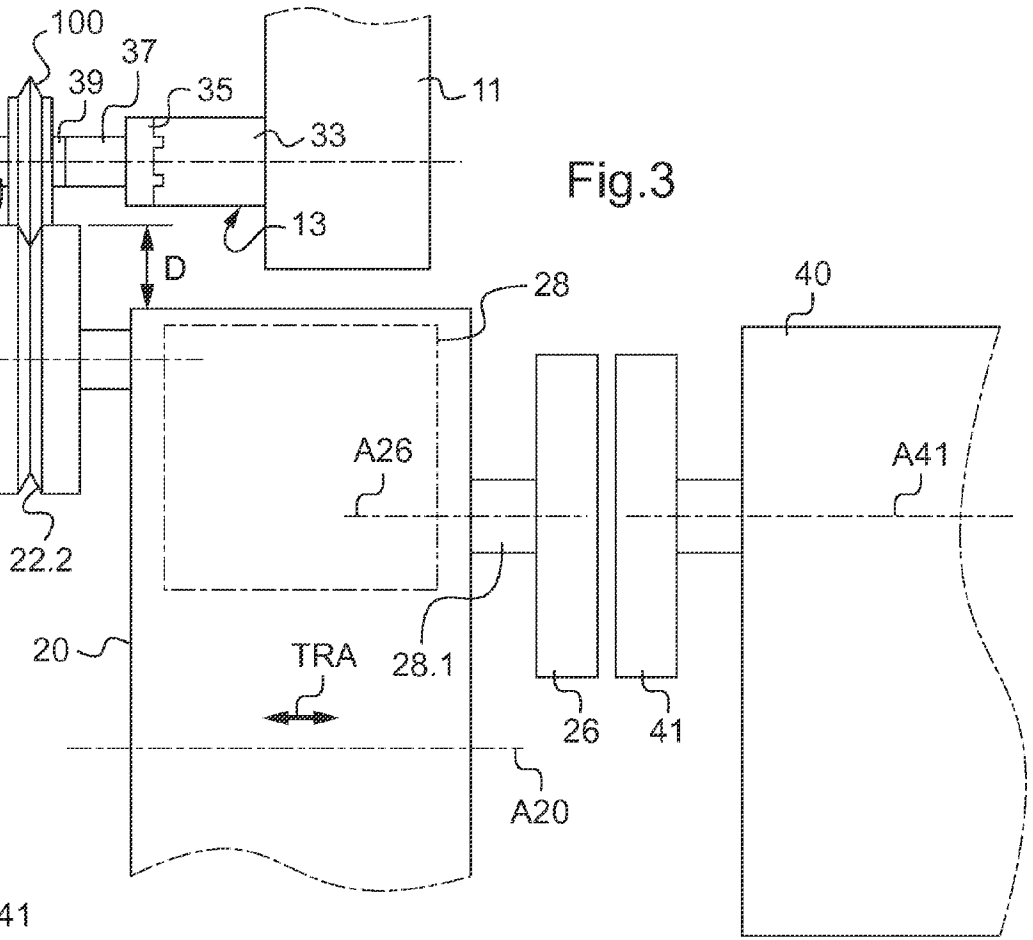
Figure 4:
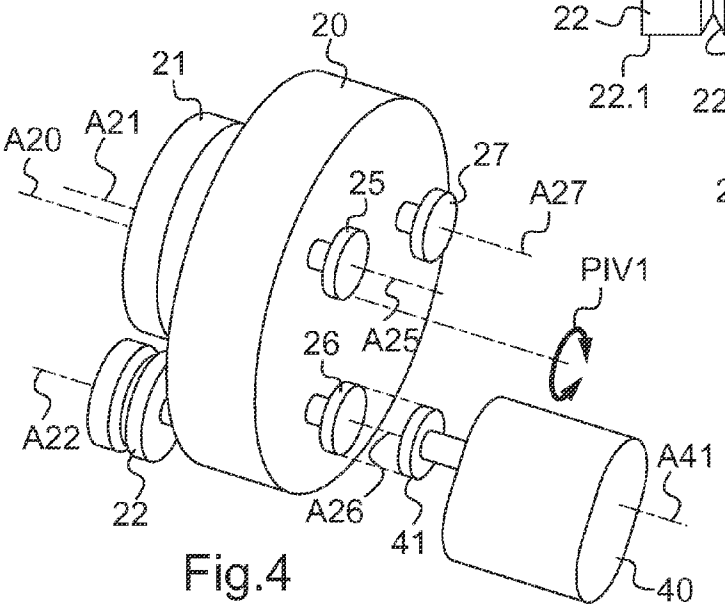

FIG. 3 is a fragmentary elevation view of the tool-carrier, showing the end of shaping a lens of very small diameter by means of a beveling grindwheel projecting from the tool-carrier; and FIG. 4 is a fragmentary diagrammatic perspective view showing the declutchable means for coupling the working tools with the common motor that drives them in rotation; and FIG. 5 schematically shows other finisher tools that can be used.

Figure 1:
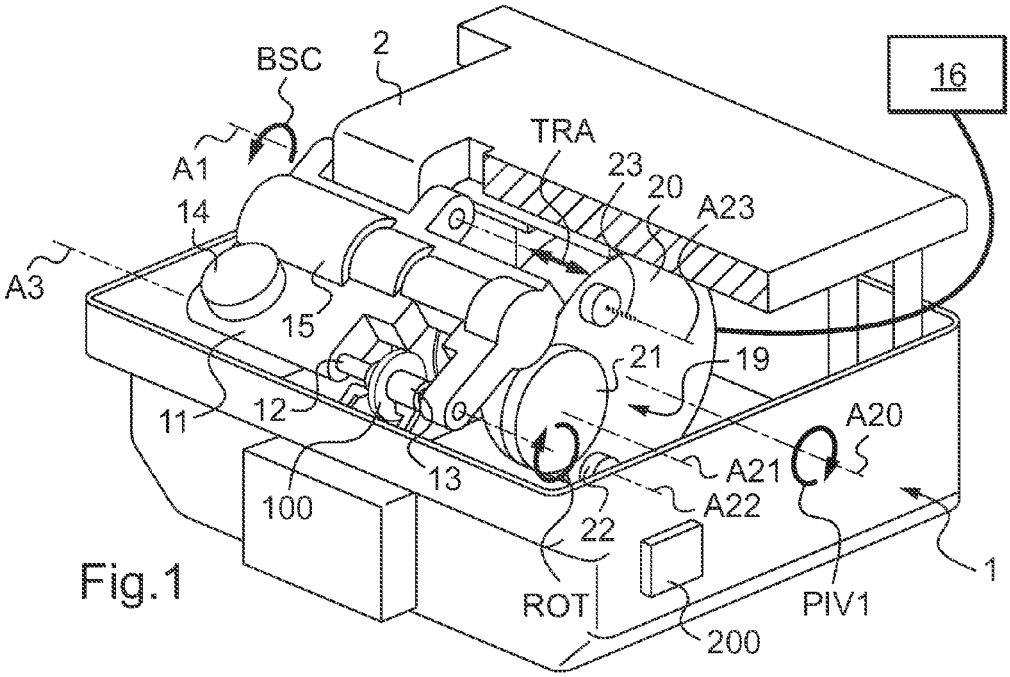
FIG. 1 is a perspective view of a shaper machine of the invention.
Figure 2:
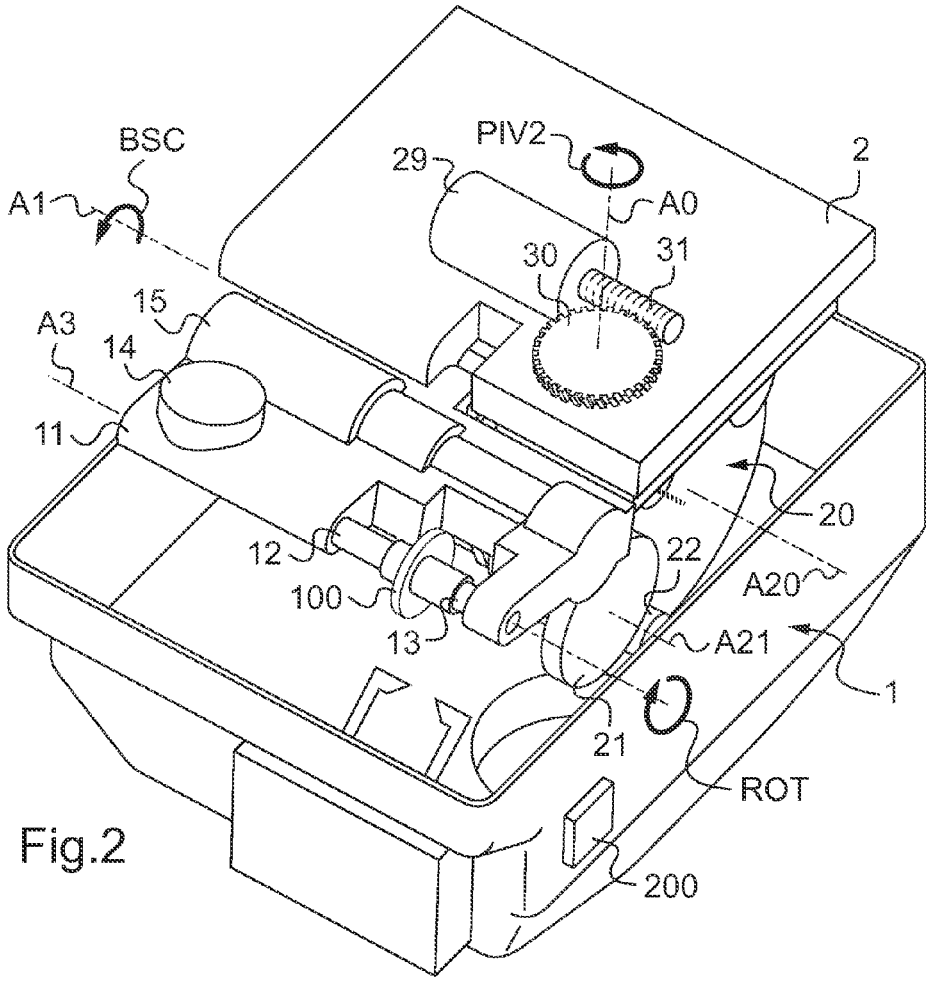
FIG. 2 is a perspective view from another angle of the shaper machine of the invention, and showing means for swiveling the tool-carrier.

FIGS. 1 and 2 show a shaper machine for shaping a corrective and/or tinted ophthalmic lens 100 for fitting to a pair of eyeglasses. The machine comprises a base-forming shell 1 that is a molding with a bottom and four side walls. Since the shell is entirely molded, it is guaranteed to be durably and reliably leaktight.

There is also provided a plate 2 that carries a rocker device 11 and machining means 19. The plate 2, which is shown diagrammatically and in part only in FIGS. 1 and 2, rests on the shell 1 so as to form a cover. Thus, while the lens 100 is being shaped, the plate 2 co-operates with the shell 1 to form a sealed housing containing the rocker device 11 and the machining means 19. The cover-forming plate 2 possesses a controlled access hatch (not shown) giving access to the inside of the housing formed thereby in order to insert and remove the lens 100.

In addition, the mechanical moving parts of the machining means 19 and of the rocker device 11 are all mounted on the plate 2 such that during a maintenance operation these elements are extracted from the shell 1 as a unit together with the cover 2 and are then directly accessible, thereby facilitating maintenance. In particular, the operator performing the maintenance operation is not hindered by the side walls of the shell 1.

The rocker device 11 is mounted on the plate 2 to pivot about a tilt axis A1. This freedom to move in pivoting is referenced BSC in FIGS. 1 and 2.

The clamping and rotary drive shafts 12 and 13 are thus movable in pivoting about the tilt axis A1 between firstly a working position in which they are situated inside the housing formed by the shell 1 and the cover-plate 2, and secondly a loading position in which they are outside the housing.

The rocker device 11 includes clamping and rotary drive shafts 12 and 13 for engaging the lens 100 and extending along a common first axis of rotation A3 that is parallel to and spaced apart from the tilt axis A1. These shafts 12 and 13 are movable in translation relative to each other along the axis A3 so as to take hold of the lens 100 and grip it vice-like.

The shafts 12 and 13, and consequently also the lens 100, are also movable in rotation about their axis A3. This rotation of the shafts 12 and 13, referenced ROT in FIGS. 1 and 2, is driven by suitable first driver means 14 such as a stepper motor and gearbox unit.

The machining means 19 comprise a tool-carrier 20 that presents a cylindrical shape forming a drum about a second axis of rotation A20 and possessing freedom to move in pivoting PIV1 about the axis A20. The pivoting PIV1 of the tool-carrier 20 about the axis A20 is driven by second driver means 16, typically constituted by a stepper motor and gearbox unit.

The tool-carrier 20 has a plurality of working tools 21, 22, 23 that are rotatable about respective tool axes A21, A22, A23 that are distinct and substantially parallel to the axis A20 of the tool-carrier.

These working tools 21, 22, and 23 are distributed around the axis A20 of the tool-carrier and specifically they comprise two tools 21, 22 for shaping the periphery, and one drill tool 23.

The tool-carrier 20 is movable in translation along the axis A20, thus enabling the tools to be moved relative to the lens along said axis, which is useful in particular during grooving, beveling, or indeed drilling. This freedom of movement is referred to as "transfer" and is referenced TRA in the figures.

In a variant, this relative freedom of movement in translation between the lens and the tool-carrier could be obtained by the rocker device 11 being designed in such a manner as to make it possible for the assembly constituted by the shafts 12 and 13 and the lens to be moved as a whole in translation.

The architecture for driving the working tools in rotation may involve the tool-carrier 20 having a plurality of outlet shafts each having one of the working tools 21, 22, or 23 mounted thereon. Each of these shafts is driven in rotation by gearing (referenced 28 for the finishing grindwheel 22), with an inlet shaft (referenced 28.1 for the above-mentioned gearing 28) coupled in declutchable manner to the outlet shaft of a common motor 40 for driving them in rotation.

Declutchable means are provided for coupling the working tools with the common motor. These coupling means are designed to declutch the coupling with the inactive working tools and to clutch the coupling with the active working tool and the common motor 40 when the tool-carrier 20 is in the working position for said tool.

Specifically, and as shown in FIGS. 3 and 4, individual declutchable magnetic coupling is provided for each tool with the common motor 40, this magnetic coupling typically being of the type comprising facing disks, such as those sold by the supplier Magnetic Technologies Ltd. This magnetic coupling mainly comprises firstly individual coupling disks 25, 26, and 27 for the axes A25, A26, and A27 associated respectively with the working tools 21, 22, 23, each being mounted to rotate on the tool-carrier 20 by being coupled to the driving gearing of the corresponding tool (in the configuration shown in FIGS. 3 and 4, the gearing 28 for driving the tool 22 is shown diagrammatically), and secondly a common coupling disk 41 coupled to the outlet shaft of the common motor 40. The common coupling disk 41 is disposed on the axis A41 of the motor 40 that is offset relative to the axis A2 of the tool-carrier 20, and the individual coupling disks 25, 26, 27 are arranged on axes A25, A26, A27 having the same offset as the driving axis A41 of the common coupling disk 41. Thus, when the tool-carrier 20 pivots about is axis A20 to place the various tools 21, 22, and 23 in succession in the working position, the individual coupling disks 25, 26, 27 are brought successively into register with the common coupling disk 41. When the tool-carrier 20 remains stationary in a given angular position in which one of the working tools (the finishing grindwheel 22 in the example of FIGS. 3 and 4) is in position for working the lens 100, the individual coupling disk associated with the tool (the disk 26 in the example of FIGS. 3 and 4) is situated facing the common coupling disk 41. In the example shown, the axes A26 and A41 coincide.

In a variant, provision can be made for the outlet shaft of the common motor 40 to rotate a common coupling gearwheel, and for the drive gearing for each of the various tools to be arranged in such a manner that turning the tool-carrier 20 causes the gearing of each of the tools to mesh individually with the common coupling gearwheel. The gearing of each of the tools then becomes engaged individually with the common coupling gearwheel solely when the tool-carrier drum is in the working position for the corresponding tool. The gearing for driving the other tools is then declutched from their coupling with the common motor. For this purpose, the common coupling gearwheel is offset from the pivot axis A20 of the tool-carrier 20.

The shaper tools 21, 22 include an edger tool 21 and a finisher tool 22. The edger tool 21 is constituted by a roughing grindwheel and the finisher tool 22 by a beveling grindwheel. The roughing grindwheel has an edging surface of revolution (specifically a cylindrical face) about its axis of rotation A21 and the grains in the roughing surface present a size of about 150 micrometers. The finisher grindwheel 22 possesses an edging face 22.1 constituted by a surface of revolution about its axis of rotation A22 with a beveling groove 22.2. Specifically, the edging face 22.1 is cylindrical, but it could advantageously be conical. Whatever it shape, the finisher grindwheel 22 presents a maximum diameter that is considerably smaller than the diameter of the roughing grindwheel 21. The size of the grains in the fishier grindwheel 22 is of the order of 55 micrometers.

As schematically shown in FIG. 5, provision may advantageously be made to add other finisher tools such as a chamfering tool, a grooving tool, or a polishing tool.

The machine also includes swivel means for pivoting the tool-carrier 20 relative to the first axis of rotation A3. These swivel means comprise a rotary connection about an axis A0 connecting the tool-carrier 20 to the plate 2. The tool-carrier 20 is thus possesses freedom of movement in pivoting PIV2 that enables the axis A20 of the tool-carrier, and consequently the axes of the working tools, to be swiveled through a certain angle relative to the axis of rotation A3 of the lens. This swiveling of the tool-carrier 20 about the axis A0 is driven by fourth driver means specifically comprising a motor 29 having its outlet shaft fitted with a wormscrew 31 meshing with a gearwheel 30 that enables the tool-carrier 20 to be swiveled about a vertical axis A0. The driver motor 29 is operated before and/or during machining of the lens by control means 200.

It should be observed that for good magnetic coupling, the individual coupling disks 25, 26, 27 should preferably remain on the same axis as the common coupling disk 41, regardless of the angular position of the tool-carrier 20 about the axis A0. Provision is therefore advantageously made for the common motor 40 and its common coupling disk 41 to be constrained to pivot PIV2 together with the tool-carrier 20 about the axis A0.

The swivel axis A0 of the tool-carrier 20 is specifically advantageously situated close to the tools so that the pivoting of the tool-carrier about this axis is not accompanied by excessive transverse movement of the tools.

The shaper tools 21 and 22 possess different diameters from one another and the axes of rotation A21 and A22 of the shaper tools 21 and 22 are situated at different distances from the second axis of rotation A20. Specifically, each shaper tool 21, 22 has an active portion that, during rotation of the shaper tool 21, 22 about its axis A21, A22, A23, defines a working envelope with the useful portion of said working envelope being situated at a maximum distance from the second axis of rotation A20 that is the same for each of the shaper tools 21, 22.

Provision may advantageously be made for the tool axis of at least one of the working tools to be inclined, typically by an angle greater than or equal to 5 degrees, relative to the second axis of rotation A20 of the tool-carrier 20. Thus, when this working tool is selected, and the tool-carrier is turned to occupy the working position for said working tool, the tool axis of this working tool can be oriented relative to the axis of rotation of the lens, by the tool-carrier 20 turning about the axis A20.

This working tool of inclined axis may typically be the beveling wheel 22 having a conical abrasive working face, or it may be a grooving disk. Under such circumstances, the angle of inclination may lie in the range 10 degrees to 30 degrees, with an identical conical half-angle at the apex.

Furthermore, as shown in particular in FIG. 3, provision is advantageously made for the grindwheels 22 and 21 to project radially from the tool-carrier 20. Thus, in FIG. 3, the grindwheel 22 can be seen to project radially by a distance D relative to the tool-carrier 20. This radial projection of the grindwheel makes it possible to machine lenses 100 of very small final diameter without interference between the rocker 11 and the tool-carrier 20.

Under such circumstances, machining lenses of very small diameter is made possible above all by the clamping shafts 12 and 13 that clamp the lens 100 being provided with narrowed ends. Relative to the body of the rocker device 11 from which it projects, each clamping shaft 12 or 13 possesses a proximal portion 32 or 33 and a terminal portion 36 or 37 of diameter that is smaller than that of the proximal portion 32 or 33. This allows grindwheels that are in register with the narrow terminal portions 36, 37 to pass between the larger proximal portions 32, 33 of the clamping shafts, while nevertheless ensuring that the shafts posses sufficient stiffness.

Specifically, the free end of each proximal portion 32, 33 is provided with a crenellated type system for engaging a fitted endpiece 34, 35 that is provided with a nose of small diameter forming the terminal portions 36, 37. The nose or terminal portion 36 of the shaft 12 co-operates at its free end with a blocking pad or accessory 38 stuck to the corresponding face of the lens 100 for embodying its frame of reference. This blocking accessory is itself well known and by way of example it is possible to use an accessory of the type described in document EP 1 266 723. The free end of the nose or terminal portion 37 of the shaft 13 is provided with an elastomer interface pellet 39 providing a high coefficient of friction with the lens so as to avoid slipping and preserve its surface state.

By way of example, the terminal portion 36, 37 of each clamping shaft 12, 13 presents a step of at least 1 millimeter in diameter relative to the upstream portion. The diameter of the terminal portion lies in the range 8 millimeters to 18 millimeters. In the example shown, the terminal portion presents a diameter of 10 millimeters and the main body 32, 33 presents a diameter of 18 millimeters.

The terminal portions 36, 37 of the clamping shafts extend over a length such that their sum is greater than or equal to the maximum width of the roughing and finishing grindwheels minus the minimum thickness of the lenses to be machined. In practice, the minimum thickness of the lenses is 2 millimeters. Consequently, by providing roughing and finishing grindwheels, each presenting a width of 17 millimeters, the sum of the lengths of the narrow terminal portions 36, 37 of the two shafts 12, 13 is at least 15 millimeters. The length of each narrow terminal portion 36, 37 should not be too great, in order to ensure that the clamping shafts remain sufficiently stiff. Specifically, the length of the narrow terminal portion 36, 37 of each clamping shaft is about 8 millimeters.

Means are provided for selecting one of the working tools 21, 22, 23 in order to proceed to a step of working the lens 100, and means are also provided for controlling the pivoting movement of the tool-carrier 20 so as to bring the selected working tool 21, 22, 23 into register with the lens 100.

The control means 200 control the means for controlling the pivoting movement of the tool-carrier 20, e.g. a device for indexing the rotary position of the tool-carrier 20. The tool-carrier rotary position indexing device is designed in such a manner that the working tools 21, 22, and 23 are prevented from moving while they are performing an edging operation.

In order to enable the spacing between the first axis of rotation A3 of the lens and the second axis of rotation A20 of the tool-carrier 20 to be adjusted dynamically during edging, use is made of the freedom of movement BSC of the rocker device 11 to tilt about the tilt axis A1. This freedom BSC is driven by third driver means, typically constituted by a motor and gearbox unit 15.

In order to machine the ophthalmic lens to have a given outline, the freedom RES of the rocker device 11 to move transversely for reproduction, and the freedom ROT of the lens shafts 12, 13 to move in rotation are controlled in coordination by a computer and electronic processor device 200 that is suitably programmed for this purpose, so that all of the points of the outline of the ophthalmic lens are brought in succession to the correct diameter.

The computer and electronic processor device 200 includes means for controlling the freedoms of the various members of the shaper machine such as the rocker device and the tool-carrier. The computer and electronic processor device 200 is constituted in this example by an electronic card designed to control the various freedoms of the working tools and of the rotary drive and clamping shafts for the lens in coordination so as to implement the automatic shaping method as explained below.

The above-described shaper machine can be used for implementing a lens shaping method in application of the following steps.

The lens is centered and clamped between the rotary drive and holding shafts 12 and 13 of the rocker device. The computer and electronic processor device 200 controls the freedom of the tool-carrier 20 to pivot so as to position the shaper tool 21 in register with the lens. Thereafter, the computer and electronic processor device 200 controls the freedom ROT of the lens to rotate, and the freedoms TRA and RES to move in transfer and reproduction so as to rough out the edging of the lens 100 with the shaper tool 21.

During this roughing step, the lens is roughed out so that its outline comes close to the shape that it is desired to impart thereto.

Preferably, for this roughing operation, care is taken to swivel the shaper tool 21, making use of the freedom of the tool-carrier to pivot in swiveling, so as to take up an angle of inclination that corresponds to the angle desired for finishing the edge face of the lens.

When processing a lens for a frame of the drilled type, once roughing has been completed, the tool-carrier pivots about its axis A20 to position the finishing tool 22 in register with the lens, and it proceeds with finishing off the edging operation by using the peripheral portion of the finishing grindwheel that does not include the beveling groove.

Thereafter, at the end of the finishing process, the tool-carrier 20 is pivoted about its axis A20 to bring the drill tool 23 into register with the lens. The freedom PIV2 to swivel the tool-carrier so as to incline its axis A20 relative to the axis of rotation A3 of the lens is then controlled so as to orient the drill tool correctly for drilling the lens.

When shaping a lens for drilling, once roughing has been completed, the tool-carrier pivots about its axis A20 so as to position the finishing tool 22 in register with the lens.

The computer and electronic processor device 200 similarly controls the freedoms of the various members of the machine so as to perform a beveling finishing operation. In a variant, provision may also be made to place a grooving tool on the tool-carrier and to groove the lens.

The freedom PIV2 to swivel the axis A20 of the tool-carrier 20 relative to the axis of rotation A3 of the lens may be controlled in such a manner as to obtain the desired shape for the periphery of the lens.

Preferably, the freedom PIV2 in swiveling is controlled so as to form a bevel or a groove at the periphery of a strongly curved lens so as to limit the extent to which the bevel or the groove is pared away while it is being formed. Since the front face of a lens is inscribed in a sphere, a strongly curved lens is defined as being a lens forming part of a sphere of radius less than 12 centimeters. For this purpose, the control means may be programmed to make use of the freedom PIV2 of the tool-carrier 20 to swivel about the axis A0 to control the angle of inclination of the tool relative to the lens, as explained in French patent application FR 06/08987 filed on Nov. 13, 2006 in the name of the Applicant.

In certain circumstances, the control means 200 are designed to control the fourth driver means for driving the means for swiveling the tool-carrier 20 about the axis A0 not only before beginning to machine the lens so as to bring the tool into the working position, but also dynamically while the lens is being machined, while the lens is being rotated about the axis A3, and in coordination with the first driver means for driving rotation of the lens. Dynamic control of the angle of inclination of the tool-carrier 20 is useful in particular when performing finishing work on the periphery of a lens such as beveling or grooving, so as to obtain more accurate mounting on the frame. This control is then preferably performed as a function of the 3D shape of the frame.

Furthermore, in order to further improve the accuracy of machining during such finishing work on the periphery of the lens, the second driver means for pivoting of the tool-carrier 20 about the second axis of rotation A20 may advantageously be controlled by the control means 200, programmed for this purpose, in coordination with the first driver means 14 for rotating the lens.

For this purpose, the control means may be programmed to make use of the two freedoms of movement of the tool-carrier 20 about the axes A0 and A20 to control the position of the tool relative to the lens in the manner explained in French application FR 05/11895 filed on Nov. 24, 2005 in the name of the Applicant.

Under such circumstances, provision is also made for the axis of the working tool (beveling or grooving tool) and for the second axis of rotation A20 of the tool-carrier 20 to be arranged in such a manner that when the working tool has been selected and the tool-carrier turned into a working position for said working tool, the axis of the working tool is inclined relative to the first axis of rotation of the lens at a certain angle. Turning of the tool-carrier 20 about the second axis of rotation A20 as a function of the angular position of the lens then produces its full effect.

This method may be applied systematically when shaping lenses independently of the value of their radius of curvature, and in particular for lenses that are not strongly curved, i.e. those forming part of a sphere of radius greater than 12 centimeters.

In order to machine lenses having a coating such as treatment against dirtying, which makes them slippery, it is possible to provide for the tool-carrier to be provided with a milling cutter tool. The control unit is programmed to use the cutter tool for roughing out the shaping of slippery lenses of this type. The torque transmitted to the lens is thus small, thus avoiding the lens slipping relative to its support. Such cutting by milling is described in greater detail in French patent application FR 06/04493 filed on May 19, 2006 by the Applicant.

When the lens for shaping is of the slippery type and, furthermore, the final diameter that is desired after shaping is too small to enable said diameter to be shaped by milling, the control unit is programmed to perform roughing in two substeps:

- the lens is milled to cut it down to a minimum threshold diameter greater than the desired diameter, the threshold diameter being predefined to avoid any conflict between the tool-carrier or the milling tool driver motor and the means 12 and 13 for supporting the lens 100 and driving it in rotation; and
- finishing the roughing operation by grinding using a roughing grindwheel to the desired diameter.

The invention claimed is:

1. A shaper machine for shaping an ophthalmic lens (100) for eyeglasses, the machine comprising:

- means (12, 13) for supporting the lens (100) for driven rotation about a first axis of rotation (A3), the rotation of the lens being driven by first drive means (14);
- a tool-carrier (20) mounted to turn about a second axis of rotation (A20), the rotation of the tool-carrier (20) being driven by second drive means;
- a plurality of working tools (21, 22, 23) mounted on the tool-carrier (20) to rotate about respective tool axes (A21, A22, A23), at least two of the tools comprising tools (21, 22) for shaping the periphery of the lens and having distinct tool axes (A21, A22) of rotation; and
- third drive means for driving relative spacing movements between the first axis of rotation (A3) and the second axis of rotation (A20);
- wherein the machine includes swivel means (29 30, 31) enabling the tool-carrier (20) to pivot relative to the first axis of rotation (A3) about a third axis of rotation (A0) that extends substantially transversely relative to the first axis of rotation (A3).

2. A shaper machine according to claim 1, wherein the working tools (21, 22, 23) include a drill tool (23).

3. A shaper machine according to claim 1, wherein the tool axis (A22) of at least one of the working tools (22) and the second axis of rotation (A20) of the tool-carrier (20) are arranged in such a manner that when said at least one working tool (22) has been selected and the tool-carrier has been turned into a working position for said at least one working tool, the tool axis (A22) of said at least one working tool (22) is inclined relative to the first axis of rotation (A3).

4. A shaper machine according to claim 1, including selector means (200) for selecting one of the working tools (21, 22, 23) to proceed with a step of working the lens (100), and control means (200) for controlling the second driver means designed to cause the tool-carrier (20) to turn about the second axis of rotation (A20) in such a manner as to bring the selected working tool (21, 22, 23) of the plurality of working tools into register with the lens (100).

5. A shaper machine according to claim 4, wherein the swivel means for enabling the swiveling of the tool-carrier (20) about the third axis of rotation (A0) are driven by fourth driver means before and/or during machining of the lens and under the control of the control means (200).

6. A shaper machine according to claim 5, wherein the control means (200) are designed to control the fourth driver means for driving the means for enabling the swiveling of the tool-carrier (20) about the third axis of rotation (A0) in coordination with the first drive means (14) for rotating the lens.

7. A shaper machine according to claim 4, wherein the control means (200) are designed to control the second driver means for turning the tool-carrier (20) about the second axis of rotation (A20) in coordination with the first drive means (14) for rotating the lens.

8. A shaper machine according to claim 1, wherein the tools for shaping (21, 22) include at least one edger tool (21) for shaping the lens to have a flat edge face, and at least one finisher tool (22) constituted by at least one of the following tools: a beveling grindwheel, a chamfering disk, a grooving tool, and a polishing tool.

9. A shaper machine according to claim 1, wherein the tools (21, 22) for shaping are of different diameters from one another and the tool axes of rotation (A21, A22) of the tools (21, 22) for shaping are situated at different distances from the second axis of rotation (A20).

10. A shaper machine according to claim 1, wherein each of the working tools (21, 22, 23) comprises an active portion that defines a working envelope during rotation of the respective working tool (21, 22, 23) about the respective tool rotation axis (A21, A22, A23), a portion of said working envelope that is situated at a maximum distance from the second axis of rotation (A20) being located at a distance from the second axis of rotation that is the same for at least two of the tools (21, 22) for shaping.

11. A shaper machine according to claim 1, including coupler means (25, 26, 27, 41) for coupling the working tools (21, 22, 23) with a common motor (40) that drives them in rotation, the coupler means being designed to enable at least one of the working tools to be decoupled from the common motor when said at least one working tool is inactive and to couple one of said working tools and the common motor (40) when the tool-carrier (20) is positioned such that the one tool is in a working position.

12. A shaper machine according to claim 1, wherein the means for supporting the lens comprises two shafts (12, 13), both arranged on the first axis of rotation (A3), for clamping the lens between their facing free ends, each shaft having a terminal portion (36, 37) of reduced diameter at its respective free end.

13. A method of shaping a lens by means of a shaper machine according to claim 1, the method comprising the following steps:

turning the tool-carrier (20) about the second axis of rotation (A20) so as to position an edger tool (21) of the plurality of working tools in register with the lens;

roughing out edging of the lens (100) by means of the edger tool (21);

turning the tool-carrier (20) about the second axis of rotation (A20) to position a finisher tool (22) of the plurality of working tools in register with the lens; and beveling or grooving the lens by means of the finisher tool (22) with the tool-carrier being swiveled about the third axis of rotation (A0) such that the second axis of rotation (A20) is at a non-zero angle with respect to the first axis of rotation (A3).

14. A method according to claim 13, that is applied systematically to shaping lenses independently of their camber.

15. A method according to claim 14, applied to lenses having a front face that is inscribed in a sphere of radius greater than 12 centimeters.

16. A method of shaping a lens by means of a shaper machine according to claim 1, the method comprising the following steps:

turning the tool-carrier (20) about the second axis of rotation (A20) so as to position an edger tool (21) of the plurality of working tools in register with the lens;

roughing out edging of the lens (100) by means of the edger tool (21) with the tool-carrier being swiveled about the third axis of rotation (A0) such that the second axis or rotation (A20) is at a non-zero angle with respect to the first axis of rotation (A3);

turning the tool-carrier (20) about the second axis of rotation (A20) to position a finisher tool (22) of the plurality of working tools in register with the lens; and beveling or grooving the lens by means of the finisher tool (22) with the second axis of rotation (A20) being at the same non-zero angle with respect to the first axis of rotation.

* * * * *

UNITED STATES PATENT AND TRADEMARK OFFICE

CERTIFICATE OF CORRECTION

PATENT NO. : 8,464,409 B2
APPLICATION NO. : 12/525916
DATED : June 18, 2013
INVENTOR(S) : Michel Nauche It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 947 days.

Signed and Sealed this
Eighth Day of September, 2015

Michelle K. Lee

Michelle K. Lee
*Director of the United States Patent and Trademark Office*